US008534030B2

(12) United States Patent
Gray

(10) Patent No.: US 8,534,030 B2
(45) Date of Patent: Sep. 17, 2013

(54) METHOD FOR METERING A LENGTH OF DUCT FROM A FLEXIBLE CONTAINER RETAINING THE DUCT IN A LONGITUDINALLY COMPRESSED STATE

(71) Applicant: William R. Gray, Coats, NC (US)

(72) Inventor: William R. Gray, Coats, NC (US)

( * ) Notice: Subject to any disclaimer, the term of this patent is extended or adjusted under 35 U.S.C. 154(b) by 0 days.

(21) Appl. No.: 13/781,898

(22) Filed: Mar. 1, 2013

(65) Prior Publication Data

US 2013/0174522 A1 Jul. 11, 2013

Related U.S. Application Data

(62) Division of application No. 13/092,206, filed on Apr. 22, 2011, now Pat. No. 8,434,287, which is a division of application No. 12/722,954, filed on Mar. 12, 2010, now Pat. No. 7,950,203, which is a division of application No. 11/204,403, filed on Aug. 16, 2005, now Pat. No. 7,681,729.

(51) Int. Cl.
*B65B 63/02* (2006.01)
*B65D 85/08* (2006.01)

(52) U.S. Cl.
USPC ..... 53/399; 53/417; 53/436; 53/449; 53/469; 53/492; 206/321

(58) Field of Classification Search
USPC ..... 53/399, 416, 417, 436, 438, 449, 53/469, 492, 176, 381.1, 384.1; 206/321, 206/446
IPC ..... B65D 85/08
See application file for complete search history.

(56) References Cited

U.S. PATENT DOCUMENTS

| | | | | | |
|---|---|---|---|---|---|
| 1,218,314 | A | * | 3/1917 | Read | 53/114 |
| 1,703,620 | A | * | 2/1929 | Hamilton | 383/71 |
| 1,871,805 | A | * | 8/1932 | Parsons et al. | 53/438 |
| 2,015,653 | A | * | 10/1935 | Andrews | 229/131.1 |
| 2,781,811 | A | * | 2/1957 | Dilar et al. | 206/423 |
| 3,310,166 | A | * | 3/1967 | Mauthe | 206/459.1 |
| 3,363,293 | A | * | 1/1968 | Nemrod et al. | 24/30.5 P |
| 3,380,221 | A | * | 4/1968 | Thiele | 53/399 |
| 3,528,825 | A | * | 9/1970 | Doughty | 206/446 |
| 3,541,752 | A | * | 11/1970 | Ness | 53/436 |
| 3,639,130 | A | * | 2/1972 | Eichin et al. | 206/446 |
| 3,747,743 | A | * | 7/1973 | Hoffmann, Jr. | 206/321 |
| 3,768,642 | A | * | 10/1973 | Hansen et al. | 206/321 |
| 3,827,210 | A | * | 8/1974 | Smalley et al. | 53/436 |
| 3,914,918 | A | * | 10/1975 | Laird | 53/399 |

(Continued)

FOREIGN PATENT DOCUMENTS

FR 2784970 A1 * 4/2000

*Primary Examiner* — Stephen F Gerrity
(74) *Attorney, Agent, or Firm* — Brian B. Shaw, Esq.; Harter Secrest & Emery LLP

(57) ABSTRACT

A method of retaining a longitudinally compressed flexible duct, the method includes removing at least one retaining strap from extending longitudinally about a flexible container retaining a longitudinally compressed flexible duct having a first end and a second end within the flexible container, the retaining strap extending about a first end and a second end of the flexible container. The method further includes securing a choker about a circumference transverse to the longitudinally compressed flexible duct and the flexible container to circumferentially compress a portion of the longitudinally compressed flexible duct at a position intermediate of the first end and the second end of the longitudinally compressed flexible duct.

17 Claims, 1 Drawing Sheet

(56) References Cited

U.S. PATENT DOCUMENTS

| | | | | | |
|---|---|---|---|---|---|
| 3,924,661 | A | * | 12/1975 | Bornhoffer | 206/446 |
| 4,235,063 | A | * | 11/1980 | Paetz | 53/436 |
| 4,288,999 | A | * | 9/1981 | Sterling et al. | 53/449 |
| 4,619,103 | A | * | 10/1986 | Kenrick | 53/436 |
| 4,771,884 | A | * | 9/1988 | Lamborn et al. | 206/321 |
| 4,921,105 | A | * | 5/1990 | Culbreth | 229/117.16 |
| 4,987,996 | A | * | 1/1991 | Anderson | 206/321 |
| 5,058,741 | A | * | 10/1991 | Anderson | 206/321 |
| 5,590,775 | A | * | 1/1997 | Moore | 206/423 |
| 5,709,064 | A | * | 1/1998 | Swartz | 53/399 |
| 5,939,156 | A | * | 8/1999 | Rossi et al. | 53/492 |
| 6,079,187 | A | * | 6/2000 | Velderman et al. | 53/436 |
| 6,089,752 | A | * | 7/2000 | Moore | 383/2 |
| 6,141,807 | A | * | 11/2000 | Tapper | 5/653 |
| 6,382,447 | B1 | * | 5/2002 | Loeschen | 206/446 |
| 7,083,331 | B2 | * | 8/2006 | Nykoluk | 383/2 |
| 7,089,716 | B2 | * | 8/2006 | Sterling | 53/438 |
| 2003/0209456 | A1 | * | 11/2003 | Gray | 206/321 |

* cited by examiner

METHOD FOR METERING A LENGTH OF DUCT FROM A FLEXIBLE CONTAINER RETAINING THE DUCT IN A LONGITUDINALLY COMPRESSED STATE

CROSS-REFERENCE TO RELATED APPLICATIONS

The present application is a division of U.S. patent application Ser. No. 13/092,206, filed Apr. 22, 2011 now U.S. Pat. No. 8,434,287, which is a division of U.S. patent application Ser. No. 12/722,954, filed Mar. 12, 2010 now U.S. Pat. No. 7,950,203, which is a division of U.S. patent application Ser. No. 11/204,403, filed Aug. 16, 2005 now U.S. Pat. No. 7,681, 729, the entire disclosures of which are hereby expressly incorporated by reference.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to metering a length of duct from a flexible container retaining the duct in a longitudinally compressed state, and more particularly to a choker for configuring the longitudinally compressed duct and the flexible container to generate tension in a portion of the container corresponding to a longitudinal expansion force of the duct, wherein the tension resists longitudinal expansion of a portion of the longitudinally compressed duct in the flexible container.

2. Description of Related Art

Flexible duct is used for the transfer of air, heated air or cooled air or other gases. Typically the flexible duct is designed for low-pressure usage, for example about 3 to 5 inches of water pressure.

The flexible duct is normally composed of an inner liner or core reinforced by a helical strand such as metal or plastic, a thick layer of flexible insulation such as fibrous glass around the liner, and a flexible plastic, i.e. polymeric, jacket surrounding the insulation.

Shipping, handling and storage costs, as well as installer convenience are substantially improved by longitudinally compressing the flexible duct into a container, typically an elongated box, having a length only a fraction of the initial (free) length of the duct.

However, upon opening the box to access the longitudinally compressed duct, the entire length of the compressed duct expands, thereby rendering it difficult to retain the unused length of duct within the box. For example, if a 10 foot length of duct were needed, the box is opened and the duct is extended to the full 25 foot length, wherein it the desired 10 foot section is then cut. Recapturing the remaining 15 feet of duct into the box is a difficult and time-consuming operation for the individual installer. Further, for longitudinally compressed duct shipped in a flexible container, such as a bag, reinsertion of the longitudinally expanded (relaxed) duct is particularly cumbersome.

Therefore, the need exists for a method of selectively metering a desired length of extended duct, without requiring or allowing the entire length of longitudinally compressed duct to expand. The need also exists for a metering system that can be employed without requiring significant additional material costs. In addition, the need exists for a metering system that can be readily utilized at job sites without requiring additional tools. A further need exists for a metering system that can effectively retain an unused length of the longitudinally compressed duct in the original container, wherein such retained duct remains substantially in the compressed state.

BRIEF SUMMARY OF THE INVENTION

The present metering system provides for the longitudinal expansion of a selected portion of a longitudinally compressed duct from a flexible container, wherein a remaining portion of the longitudinally compressed duct remains substantially in the longitudinally compressed state and within the container.

The present invention allows for the selective removal of a length of duct, including a generally predetermined length of duct, from a flexible container, wherein only the predetermined length of duct is allowed to change from a longitudinally compressed state to an extended or relaxed (free) state. Therefore, in one configuration the present invention removes the prior requirement of having to recompress any unused length of duct into the container.

In one configuration, the metering system includes a flexible container having a closeable first end and a longitudinally spaced closed second end; a longitudinally compressed flexible duct within the flexible container, the duct exerting a longitudinal expansion force; and a choker extending about the flexible container at a position spaced from the closed second end to locate a section of the longitudinally compressed duct intermediate the closed second end and the spaced position, the choker substantially precluding passage of the longitudinally compressed duct past the choker to the first end of the container, generating a tension in the flexible container between the closed end and the spaced position in response to the longitudinal expansion force of the retained duct.

In is further contemplated the method of metering can include closing a flexible container about a longitudinally compressed flexible duct; and disposing a strap about the flexible container to restrict a radial dimension of the container and resist longitudinal expansion of the duct, wherein a portion of the longitudinally compressed duct is extended.

BRIEF DESCRIPTION OF THE SEVERAL VIEWS OF THE DRAWING(S)

DETAILED DESCRIPTION OF THE INVENTION

Figure 1:
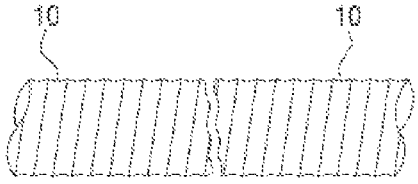
FIG. 1 is a perspective view of a given length of flexible duct in a free, extended or relaxed state.

The present system provides for the controlled release of a flexible duct 10 as seen in FIG. 1.

The flexible duct 10 is often used to transport fluids such as heated, cooled or exhaust air. The duct 10 can have any of a variety of configurations. Typically, the flexible duct 10 has a tubular construction formed by a resilient, such as wire, helix disposed between at least two pliable layers. The duct 10 thus provides a channel through which the fluid travels. As used in describing the duct 10, the term longitudinal means along a length of the duct, such as extending between ends of the duct. The term radial is used to describe a direction transverse to the longitudinal direction.

For purposes of illustration, a representative duct 10 is described, without limiting the metering system. An industry available duct 10 included a flame penetration resistant duct 10 having a plurality of concentric components. The concentric components include a flexible core, a reinforcing layer, an insulative layer and a retaining jacket. It is understood the components employed in a given duct are dictated by design considerations, and applicable building or construction codes setting forth the minimum standards which must be satisfied.

The core includes a flexible inner layer and a supporting helix, such as a resilient metal or polymer. The pitch and resilience of the helix are dictated by the intended operating parameters of the duct 10.

In the flame penetration resistant duct, the reinforcing layer is wrapped about the core. The reinforcing layer is typically a fiberglass netting, yarn or scrim. In the scrim configuration, the scrim is wrapped about the outside of the flexible core so as to encircle the core.

The insulative layer can be a fiberglass blanket wrapped about the scrim and the core. The insulative layer enhances the thermal integrity of the transported fluid. The insulative capacity of the fiberglass blanket is determined by the fluid to be transported and the permissible heat transfer rate from the fluid.

The retaining jacket is a plastic sheath wrapped about the insulative layer, the reinforcing layer and the core to provide an outer housing which retains the components in the proper orientation and relation. It is understood the duct 10 can be formed by the core and the relating jacket surrounding the core.

A further construction of the duct 10 is shown in U.S. Pat. No. 5,526,849, herein incorporated by reference.

Figure 2:
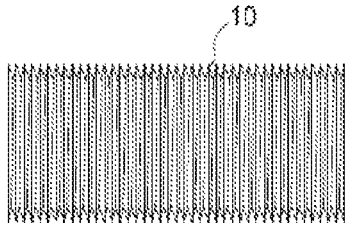
FIG. 2 is a perspective view of the given length of duct of FIG. 1 in a longitudinally compressed state.

Significant lengths of the duct 10 may be required in a given building. To minimize storage and shipping costs, the duct 10 is usually retained in a longitudinally compressed state within a container. Thus, the duct 10 has a relaxed, extended or free state seen in FIG. 1 and a longitudinally compressed state shown in FIGS. 2-7. As seen in FIGS. 1 and 2, a given length of the duct 10 can be longitudinally compressed into a substantially reduced length. For example, a 25 foot length of the duct 10 can be longitudinally compressed down to a length of approximately 48 inches to 36 inches or less.

Due to resiliency in the components of the duct 10, the longitudinally compressed duct 10 exerts a longitudinal expansion force tending to return the duct to the uncompressed length. This longitudinal expansion force is counteracted by the container and/or secondary retaining straps 40.

Figure 3:
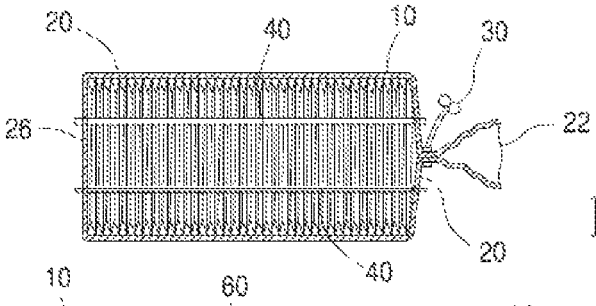
FIG. 3 is a perspective view of a flexible container and retaining straps retaining the given length of flexible duct in a longitudinally compressed state.
Figure 4:
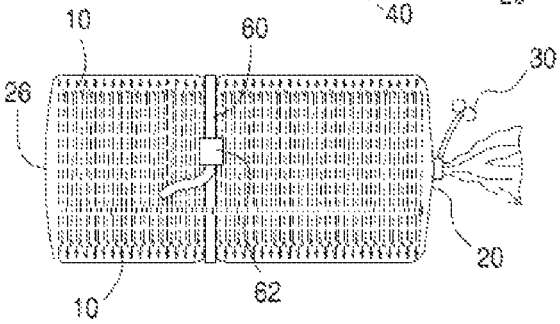
FIG. 4 is a side elevational schematic of the container and the duct of FIG. 3, with a choker engaged with the container.

Referring to FIG. 3, a configuration of the flexible container 20 is shown in partial cutaway with the given length of the longitudinally compressed duct 10 retained in the container. It is understood the compressed duct 10 may also have an overlying accordion or pleated configuration (taken herein to be encompassed by the description of "longitudinally compressed").

The container 20 has the general shape of an elongated tube, with a first end 22 and a second end 26. In one configuration, the first end 22 is an openable/re-closable end. The first end 22 can be re-closable by any of a variety of closure mechanisms 30 described herein. The second end 26 of the flexible container 20 can be a closed or sealed end.

The container 20 can be formed from any of a variety of materials including polymers such as polypropylene or polyethylene. A satisfactory material has been found to be polypropylene having a thickness of approximately 2-12 mils. It is also understood the container 20 can be formed of a laminate or a plurality of layers. The container 20 is at least locally deformable, flexible, pliable or resilient to allow the container to effect engagement of a choker 60, the container and the longitudinally compressed duct 10.

In one configuration, the container 20 has sufficient strength (tensile strength) to substantially withstand the longitudinal expansion force of the longitudinally compressed duct 10 within the container. It is understood that cost considerations can dictate that the container 20 elongate a limited percentage when subject to the full expansion force of the longitudinally compressed duct 10. Alternatively, the container 20 can be of such material, such as a Kevlar reinforced sheet, that can withstand the expansion force of the longitudinally compressed duct 10 without any material elongation.

The supplemental or secondary retaining straps 40 can be applied to the flexible duct 10 either prior to retention within the container 20, or extending about the container (with the longitudinally compressed duct retained within the container). The retaining straps 40 can be a relatively inextensible material (with respect to the expansion forces of the duct 10), and can thus resist the expansion force such that the container 20 is not tensioned by the expansion force. The retaining straps 40 are well known in the packaging industry, and are commercially available.

Typically, the flexible duct 10 is loaded into the container 20 by inserting a length of the duct 10 through the open end 22 until a leading end of the duct abuts the closed second end 26. The duct 10 is then compressed into the container 20 by a suitable apparatus such as a ram or plunger, until a trailing end of the duct has passed the open first end 22 of the container.

The open first end 22 of the container 20 is then secured by any of a variety of closure mechanisms 30 such as ties, tape, cleats, knots or adhesives. The ties can include plastic or wire ties.

If desired, the retaining straps 40 can then be applied to resist the longitudinal expansion force of the retained longitudinally compressed duct 10. The retaining straps 40 can be sized to counteract all or substantially all of the longitudinal expansion force of the retained longitudinally compressed duct 10. That is, the flexible container 20 can be substantially tension free upon engagement of the retaining straps 40. Alternatively, the flexible container 20 can be sufficiently tensioned to balance all or substantially all of the expansion force from the longitudinally compressed duct 10.

It is understood the longitudinally compressed duct 10 can be temporarily retained in the container 20, prior to applying the retaining straps 40. That is, the flexible container 20 can be closed by a tie or similar fastener 30 to restrain the longitudinally compressed duct 10. Subsequently, and typically prior to significant elongation of the flexible container 20, the retaining straps 40 are applied to restrain elongation of the longitudinally compressed duct 10.

In the configuration with the retaining straps 40 disposed about the outside of the container 20, the longitudinally compressed duct 10 exerts the longitudinally directed expansion force against the straps, and for those constructions of the straps having a smaller longitudinal dimension than the container, the container is not materially tensioned by the longitudinal expansion force of the longitudinally compressed duct.

Alternatively, if the retaining straps 40 are disposed about the longitudinally compressed duct 10, within the container 20, then upon release or removal of the retaining straps, the longitudinally compressed duct exerts the longitudinally directed expansion force against the inside of the container.

Although the container 20 has been described in connection with the retaining straps 40, it is understood the present invention is not limited to such configuration, and can be employed with those containers that do not employ the longitudinal retaining straps.

To meter the release of the longitudinally compressed duct 10 from the container 20, any retaining straps 40 are removed. The longitudinal expansion force of the compressed duct 10 then acts against the closed first end 22 of the container 20 and the closed second end 26 of the container.

The choker 60 is a device for restricting a local diameter of the container 20 by a sufficient amount to contact, engage and even partially radially compress the longitudinally compressed duct 10 within the container. Typically, the choker 60 is a strap or belt of flexible material having a circumference at least as great as the container 20.

The choker 60 can cooperate with a clip or cleat 62 for maintaining a given periphery of the choker. The clip 62 can have any of the variety of configurations, such as a belt buckle, detent mechanism, a cam that rotates into and out of contact with the choker 60 or a finger. The choker 60 can include a periphery maintaining structure such as a typical clothing belt having a series of apertures and a finger moveable into and out of engagement with the apertures.

In one configuration, the choker 60 is formed by the retaining straps 40 (after removal from the operable position along the longitudinal dimension of the container 20), wherein the choker cooperates with the clip 62 to maintain the desired reduced local periphery of the container.

The choker 60 is disposed about a periphery of the container 20 intermediate the closed first end 22 and the closed second end 26. The choker 60 restricts a local periphery of the container 20 by a sufficient amount such that the expansion force of the retained compressed duct 10 acts against the closed second end 26 of the container 20 and the choker, thereby creating a tension in the container between the choker and the closed second end. That is, the choker 60 radially restricts the container 20 and the corresponding local section of the retained longitudinally compressed duct 10. It is believed the portion of the container 20 pinched between the restricted periphery of the choker 60 and the compressed duct 10 becomes sufficiently bound relative the choker and the local compressed duct, that the container does not slip or slide between the choker and the container. Thus, upon opening the first end 22 of the container 20 the choker provides for the expansion force of the longitudinally compressed duct 10 between the closed second end 26 and the choker to create a tension in the corresponding section of the container 20. In addition, the choker 60 can define an opening (periphery) that is too small for the retained portion of the longitudinally compressed duct to pass through.

The choker 60 is thus tightened about a periphery of the container 20 intermediate the closed first end 22 and the closed second end 26. The closed first end 22 of the container 20 is then opened and the portion of the longitudinally compressed duct 10 between the choker 60 and the open first end of the container expands as a result of the longitudinal expansion force. The retained portion of the longitudinally compressed duct 10 exerts the longitudinal expansion force against the closed second end 26 of the container 20 and the choker 60, thereby generating tension in the container between the closed second end and the choker. This tension in the container 20 resists further longitudinal expansion of the retained longitudinally compressed duct 10. Thus, the portion of the longitudinally compressed duct between the closed second end 26 of the container 20 and the choker 60 remains substantially in the compressed state. In one configuration, the retained longitudinal compression is sufficient to substantially preclude the admission (or introduction) of air into voided portions of the duct 10. Specifically, for those constructions of the duct 10 having a glass fiber insulating layer, the longitudinal compression of the duct removes a substantial portion of the interstitial spaces within the insulation, thereby forcing a substantial amount of the air from the insulation. In one configuration of the system, engagement of the choker 60 with the container 20 and the corresponding local portion of the retained longitudinally compressed duct 10 is sufficient to substantially preclude expansion of compressed interstitial spaces in the retained longitudinally compressed duct. By maintaining the collapsed interstitial spacing, air is not entrained into the longitudinally compressed duct 10, and thus the compressed state is substantially maintained (or at least sufficiently maintained so that any remaining length of the longitudinally compressed duct fits within the container 20).

Figure 5:
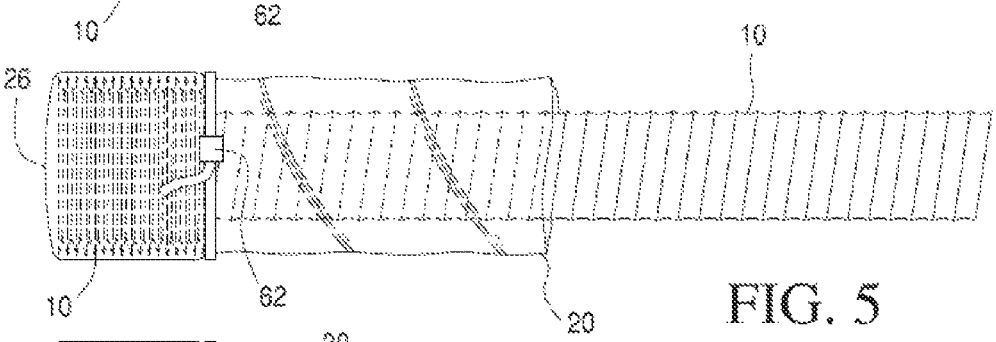
FIG. 5 is a side elevational schematic of the container, the duct and the choker of FIG. 4, showing a released portion of the duct in the free state and a retained portion of the duct in the longitudinally compressed state.
Figure 6:
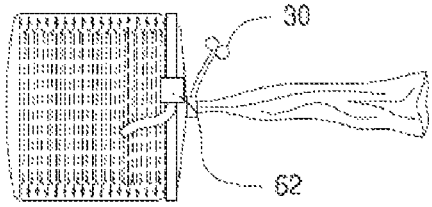
FIG. 6 is a side elevational schematic of the container, the duct and the choker of FIG. 5, showing re-closure of the flexible container after separation of the released portion of the duct while maintaining the retained portion of the duct in the longitudinally compressed state.
Figure 7:
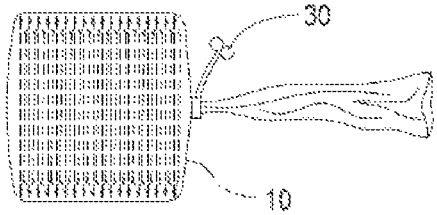
FIG. 7 is a side elevational schematic of the container and the duct of FIG. 6, after re-closure of the flexible container showing the retained portion of the duct in the longitudinally compressed state.

As seen in FIG. 5, upon applying the choker 60 and opening the first end 22, a released length of the duct 10 extends from the free end of the duct to the choker 60 and a retained compressed length extends from the choker to the closed second end 26 of the container 20.

The released, and generally extended length of the duct 10, is then cut. Typically the duct 10 is cut proximal to the choker 60 (typically within inches). This reduces the amount of duct 10 that must be re-compressed longitudinally to the disposed within the container 20. However, it is understood the released length of duct 10 can be cut outside, or spaced from the open end 22 of the container 20. The first end 22 of the container 20 can then be re-closed or resealed adjacent the choker 60, the choker removed and the container (with a retained longitudinally compressed duct 10) transported and stored in an economical manner.

It is also contemplated the choker 60 can remain engaged with the container 20, without requiring a re-closure of the first end 22 of the container.

It is believed the choker 60 sufficiently reduces the local diameter of the container 20 to cause a length of the container intermediate the choker and the closed second end 26 of the container to resist longitudinal expansion of the duct 10. That is, such portion of the container 20 is put into tension by the longitudinal expansion force of the duct 10.

It has been found that the amount of radial compression from the choker 60 against the longitudinally compressed duct 10 is below a deformation threshold of the duct. That is, the present metering system does not create unusable portions of the duct 10. The amount of constriction by the choker 60 is a balance between (i) a sufficient amount of constriction to preclude significant longitudinal expansion of the duct 10 from the compressed state, intermediate the choker and the closed second end 26 of the container 20, and (ii) a constriction which would degradingly deform a local region of the duct in the compressed state.

It is further contemplated the container 20 can include a scale, gradations, markings or rulings corresponding to an extended (free) length of the duct 10. That is, if a 25 foot length of flexible duct 10 is compressed to 4 feet, the container 20 may include markings at approximately every 9.6 inches, wherein each marking represents approximately a 5 foot length of extended (free) duct. Thus, an installer can set the choker 60 at approximately 20 inches from the closed first end 22 of the container 20, then open the first end thereby extracting approximately 10 feet of duct, while the remaining 15 feet of duct (between the choker and the closed second end 26) substantially remains in the longitudinally compressed state.

Alternatively, or in combination with the scale or gradations, the container 20 can include an equivalency or correspondence between a compressed length of duct 10 to a relaxed or nominal length of duct. For example, the container 20 may include a statement conveying the information that "1 inch of compressed duct equals approximately 1¼ feet of duct in the relaxed state."

While the invention has been described in connection with a particular embodiment, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. A method comprising:

(a) removing at least one retaining strap from extending longitudinally about a flexible container retaining a longitudinally compressed flexible duct, the longitudinally compressed flexible duct having a first end and a second end within the flexible container, the retaining strap extending about a first end and a second end of the flexible container; and (b) securing at least a portion of the retaining strap about a circumference transverse to the longitudinally compressed flexible duct and the flexible container to circumferentially compress a portion of the longitudinally compressed flexible duct at a position intermediate of the first end and the second end of the longitudinally compressed flexible duct.

2. The method of claim 1, further comprising opening the first end of the flexible container to expand longitudinally a first portion of the longitudinally compressed flexible duct intermediate the secured portion of the retaining strap and the first end of the flexible container.

3. The method of claim 1, further comprising retaining a second portion of the longitudinally compressed flexible duct between the second end of the flexible container and the secured portion of the retaining strap.

4. The method of claim 1, further comprising opening the first end of the flexible container to generate a tension in the flexible container between the second end of the flexible container and the secured portion of the retaining strap.

5. The method of claim 4, wherein the tension is sufficient to resist expansion of the longitudinally compressed flexible duct retained between the second end of the flexible container and the secured portion of the retaining strap.

6. The method of claim 1, wherein the flexible container includes markings providing a correspondence between a compressed length of the flexible duct and an uncompressed length of the flexible duct.

7. The method of claim 1, wherein securing at least the portion of the retaining strap includes using a clip.

8. The method of claim 1, wherein the flexible container is plastic.

9. The method of claim 1, wherein the secured portion of the retaining strap is sized to induce a tension in the flexible container between the secured portion of the retaining strap and the second end of the flexible container.

10. The method of claim 1, wherein the flexible container includes one of polypropylene and polyethylene.

11. The method of claim 1, further comprising opening the first end of the flexible container to allow expansion of a portion of the longitudinally compressed flexible duct through the opened first end of the flexible container; and retaining a remaining portion of the longitudinally compressible flexible duct between the secured portion of the retaining strap and the second end of the flexible container.

12. The method of claim 1, further comprising opening the first end of the flexible container to allow longitudinal expansion of a portion of the longitudinally compressed flexible duct through the opened first end of the flexible container; and cutting off a length of the portion passing through the opened first end of the flexible container.

13. The method of claim 1, further comprising opening the first end of the flexible container to retain a portion of the longitudinally compressed flexible duct intermediate the second end of the flexible container and the secured portion of the retaining strap.

14. The method of claim 1, further comprising opening the first end of the flexible container to retain a portion of the longitudinally compressed flexible duct intermediate the second end of the flexible container and the secured portion of the retaining strap; and passing a remaining portion of the flexible duct through the open first end of the flexible container.

15. The method of claim 1, further comprising opening the first end of the flexible container to retain a portion of the longitudinally compressed flexible duct intermediate the second end of the flexible container and the secured portion of the retaining strap, wherein opening the first end of the flexible container generates a tension in the flexible container extending between the second end of the flexible container and the secured portion of the retaining strap.

16. The method of claim 1, further comprising opening the first end of the flexible container to retain a portion of the longitudinally compressed flexible duct intermediate the second end of the flexible container and the secured portion of the retaining strap, wherein opening the first end of the flexible container generates a tension in the flexible container extending between the second end of the flexible container and the secured portion of the retaining strap, wherein the tension is sufficient to resist expansion of the longitudinally compressed flexible duct retained between the second end of the flexible container and the secured portion of the retaining strap.

17. The method of claim 1, further comprising opening the first end of the flexible container to retain a portion of the longitudinally compressed flexible duct intermediate the second end of the flexible container and the secured portion of the retaining strap.

* * * * *